United States Patent [19]

Jong

[11] Patent Number: 4,963,720

[45] Date of Patent: Oct. 16, 1990

[54] APPARATUS FOR COUNTING LUMP FOODSTUFFS

[76] Inventor: Jiunn-Neng Jong, No. 656, Chung-Yuan Lane, Chu-Wei Tsun, Nei-Pu Hsiang, Pingtung Hsien, Taiwan

[21] Appl. No.: 446,078

[22] Filed: Dec. 5, 1989

[51] Int. Cl.[5] ..... G06M 7/04

[52] U.S. Cl. ..... 235/98 R; 235/98 C; 377/6

[58] Field of Search ..... 235/98 R, 98 C; 377/6, 377/7

[56] References Cited

U.S. PATENT DOCUMENTS

| | | | |
|---|---|---|---|
| 2,594,337 | 4/1952 | Noe | 235/98 R |
| 2,632,588 | 3/1953 | Hoar, Jr. | 235/98 C |
| 3,317,131 | 5/1967 | Walsh | 235/98 B |
| 4,472,819 | 9/1984 | Constantino | 377/6 |
| 4,590,364 | 5/1986 | McDonald et al. | 235/98 C |

*Primary Examiner*—Benjamin R. Fuller
*Attorney, Agent, or Firm*—Knobbe, Martens, Olson & Bear

[57] ABSTRACT

An apparatus for counting lump foodstuff includes a machine frame, a foodstuff feeding funnel fixed on the machine frame, a power-operated sheave unit mounted rotatably under the funnel, a conveyer belt unit disposed revolvably under the sheave unit, and a foodstuff collecting unit disposed under the conveyer belt unit. The sheave unit has several parallel grooves formed in the circumferential surface thereof. The conveyer belt unit includes several parallel belts which are engaged with the grooves of two power-operated pulleys. Any adjacent pair of the belts define therebetween a slot which is aligned with one of the grooves in the sheave unit. Rows of counters detect the foodstuffs which drop from the conveyer belt unit into the foodstuff collecting unit. In order to separate the foodstuffs into several groups according to the sizes thereof, the belts may be arranged so as to increase the width of the slots from the charge end of the conveyer belt unit to the discharge end of the conveyer belt unit, and several collecting tanks are disposed under the conveyer belt unit along the length of the same.

4 Claims, 4 Drawing Sheets

APPARATUS FOR COUNTING LUMP FOODSTUFFS

BACKGROUND OF THE INVENTION

This invention relates to an apparatus for counting lump foodstuffs.

In this art, people usually count lump foodstuffs, which are received within a container, with their eyes. This visual counting process is time-consuming.

SUMMARY OF THE INVENTION

The main object of this invention is to provide an apparatus for effectively counting lump foodstuffs.

Another object of this invention is to provide an apparatus for counting lump foodstuffs which can simultaneously separate said lump foodstuffs into several containers in accordance with the sizes of said lump foodstuffs.

According to this invention, an apparatus for counting lump foodstuffs includes a machine frame, a foodstuff feeding funnel fixed on said machine frame, and a sheave unit mounted rotatably on said machine frame under said funnel so as to receive said foodstuffs which drop from said funnel. The sheave unit has a plurality of parallel annular grooves formed therein. Because the sheave unit rotates in a predetermined direction, all of the foodstuffs drop from a side of said sheave unit. The charge end of a conveyer belt unit is disposed under the sheave unit so as to receive the foodstuffs dropping from said sheave unit. The conveyor belt unit includes two separate belt pulleys mounted rotatably on the machine frame, and a plurality of spaced-apart endless belts engaged with said pulleys so as to form a slot between each adjacent pair of said belts. Each of said slots has a first end and a second end. The first ends of the slots correspond to the charge end of the conveyer belt unit so as to receive the foodstuffs dropping from the sheave unit within said slots in said charge end of said conveyer belt unit. The pulleys effect a unidirectional rotation so as to move the foodstuffs on the conveyer belt unit from the first ends of the slots to the second ends of said slots. A foodstuff collecting unit is disposed under the conveyer belt unit so as to collect the foodstuffs which drop therefrom. A plurality of counters respectively count the foodstuffs which drop from one of the slots in the conveyer belt unit into the collecting unit. Therefore, the foodstuffs dropping from the sheave unit can be dispersed on the conveyer belt unit so as to enable all of said foodstuffs to be counted by the counters.

Preferably, the width of the slots in the conveyer second ends thereof. The foodstuff collecting unit includes a series of collecting tanks positioned under the slots along the length of the conveyer belt unit. Accordingly, the foodstuffs of smaller sizes are collected in the collecting tanks nearer to the first ends of the slots, while the foodstuffs of larger sizes are collected in said collecting tanks nearer to the second ends of said slots.

In one embodiment, the sheave unit includes a rotating shaft mounted rotatably on the machine frame, and a plurality of endless belts sleeved rigidly on said rotating shaft.

BRIEF DESCRIPTION OF THE DRAWING

Other features and advantages of this invention will become apparent in the following detailed description of the preferred embodiments of this invention, with reference to the accompanying drawings in which.

DETAILED DESCRIPTION OF THE PREFERRED EMBODIMENTS

Figure 1:
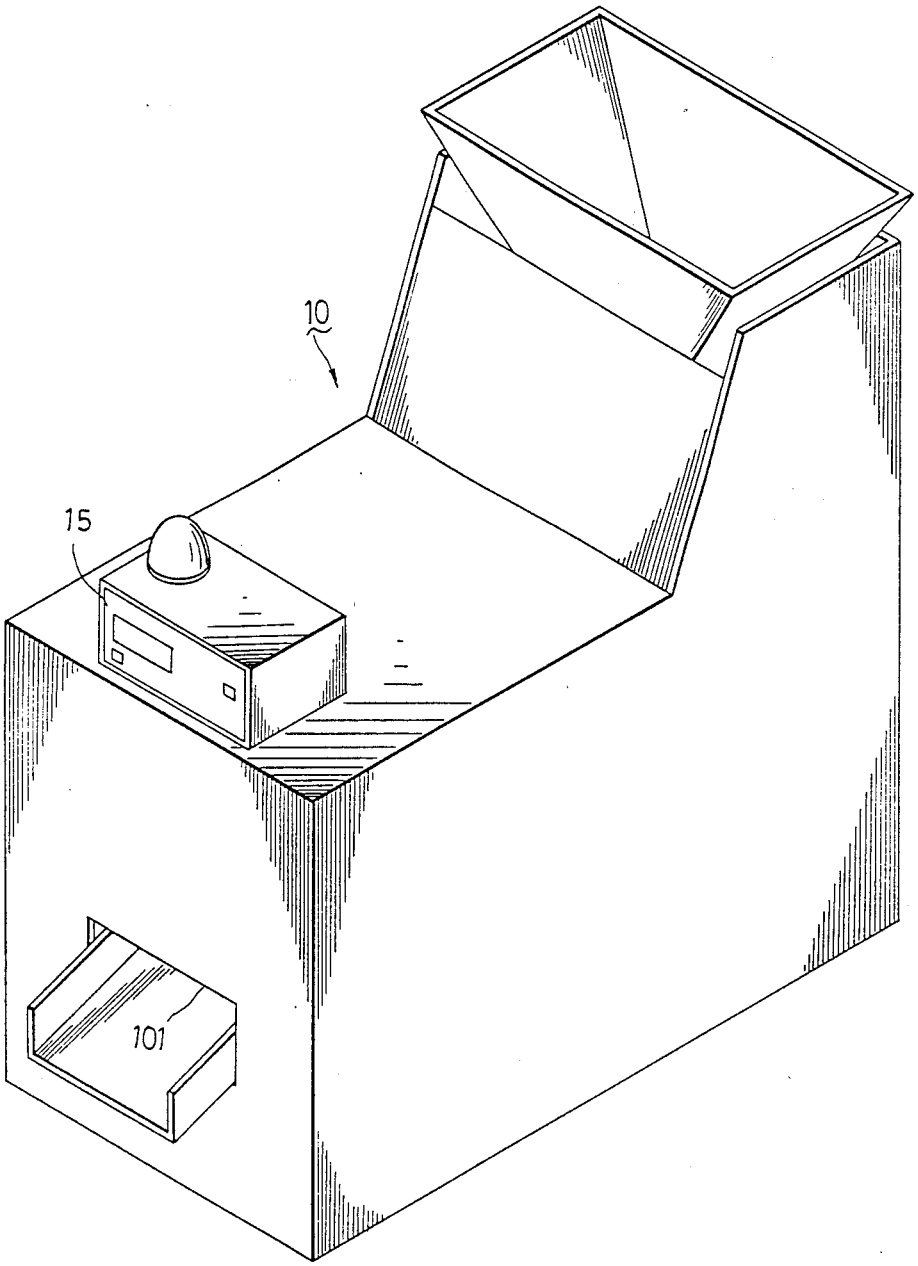
FIG. 1 a perspective view of an apparatus for counting lump foodstuffs according to this invention.
Figure 2:
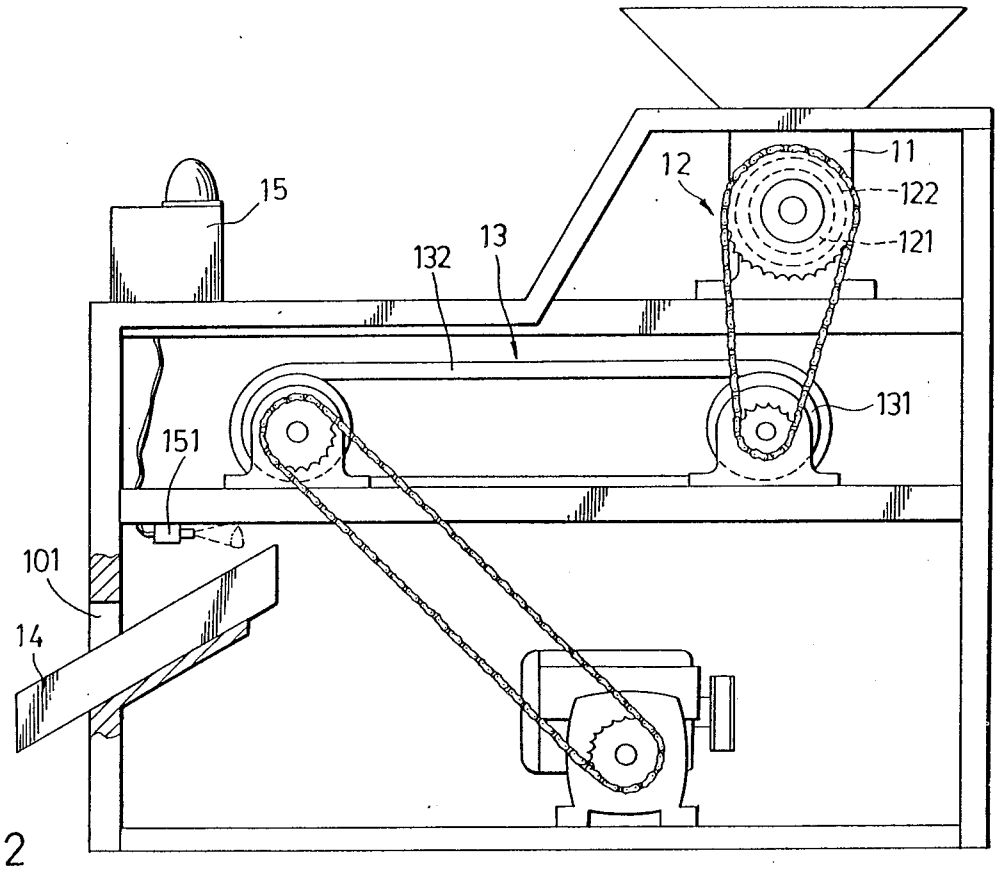
FIG. 2 is a schematic view showing the interior structure of the apparatus for counting lump foodstuffs according to this invention.

Referring to FIGS. 1 and 2, an apparatus for counting lump foodstuffs according to this invention includes a machine frame 10, a foodstuff feeding funnel 11, a sheave unit 12, a conveyer belt unit 13, a foodstuff collecting unit 14 and a counting unit 15. The lump foodstuffs to be counted enter the apparatus through the funnel 11 and exit from the apparatus through a discharge frame 101 after being counted.

Figure 3:
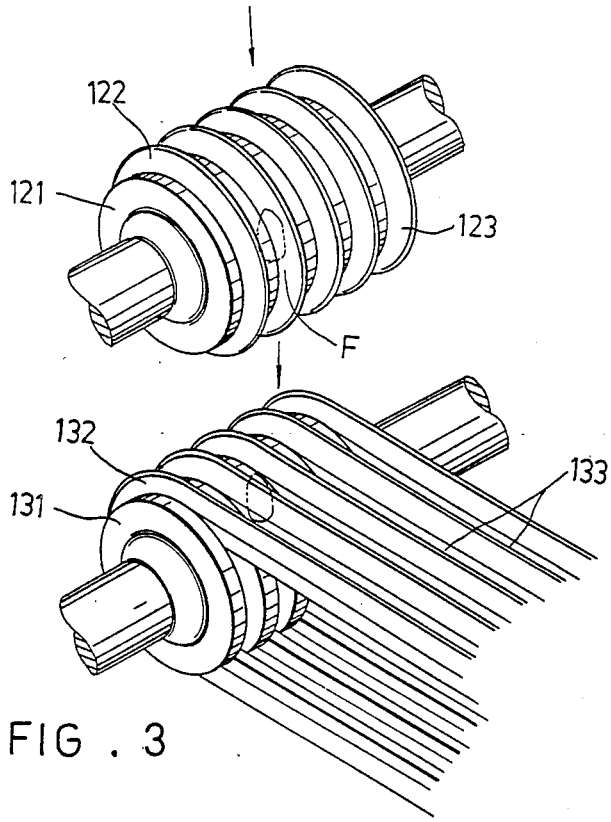
FIG. 3 is a perspective view illustrating the position of the sheave unit relative to the conveyer belt unit of the apparatus for counting lump foodstuffs according to this invention.

As shown in FIG. 3, the sheave unit 12 includes a power-operated rotating shaft 121 mounted rotatably on the machine frame 10, and five parallel belts 122 sleeved rigidly on the rotating shaft 121 so as to form four annular grooves 123 in the sheave unit 12. The foodstuffs drop from the funnel 11 to partially engage with the grooves 123 and are carried frictionally by the sheave unit 12 to rotate to a side (F) of the sheave unit 12. When the foodstuffs drop onto the sheave unit 12, the sheave unit 12 is rotating so as to enable the foodstuffs to separate. Then, the foodstuffs drop from the sheave unit 12 onto the charge end of the conveyer belt unit 13.

The conveyer belt unit 13 includes two power-operated belt pulleys 131 and five belts 132 engaged with the grooves in the pulleys 131. Each adjacent pair of belts 132 define therebetween a slot 133 which is aligned with one of the grooves 123 in the sheave unit 12. Accordingly, the foodstuffs from the sheave unit 12 fall into the slots 133 and advance along the same. The belts 122, 132 may be made of rubber or polyurethane.

Figure 4:
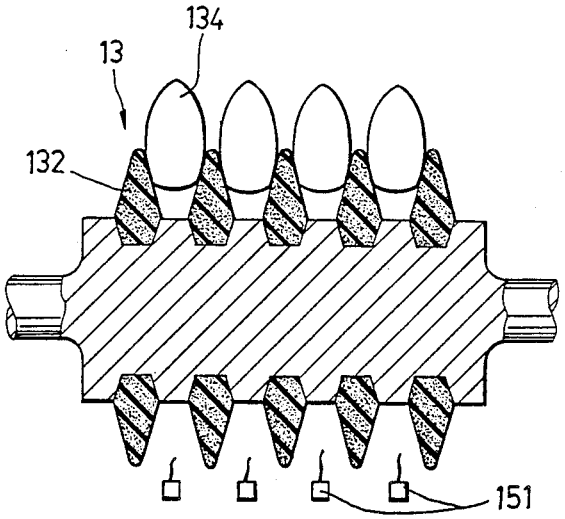
FIG. 4 is a schematic view illustrating the positions of the counters in the apparatus for counting lump foodstuffs according to this invention.
Figure 4:
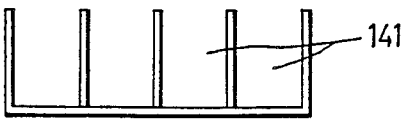

Referring to FIGS. 2 and 4, the foodstuff collecting unit 14 includes four parallel small collecting tanks 141 positioned under the slots 133 in the conveyer belt unit 13. The counting unit 15 includes a row of four counters 151 disposed between the sheave unit 12 and the foodstuff collecting unit 14. Each of the counters 151 is aligned with both one of the slots 133 and one of the collecting tanks 141. Accordingly, all of the foodstuffs 134 dropping from the conveyer belt unit 13 to the foodstuff collecting unit 14 must be detected by the counters 151. Then, the main control unit of the counting unit 15 can total the number of the foodstuffs which are detected by the respective counters 151. A selected number can be preset in the main control subunit of the counting unit 15. When the number of the foodstuffs detected by the counters 151 reaches the preselected number, the main control subunit of the counting unit 15 can stop the pulleys 131 of the conveyer belt unit 13.

Figure 5:
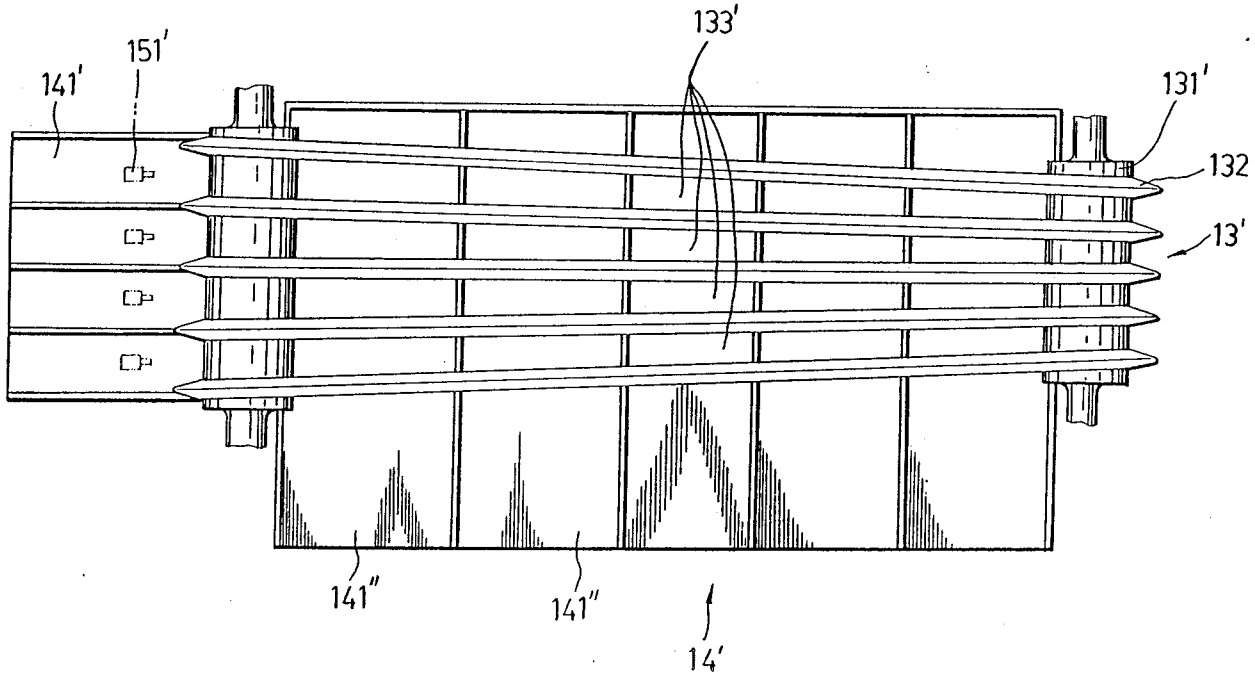
FIG. 5 is a top view showing another embodiment of the apparatus for counting lump foodstuffs according to this invention.

To separate lump foodstuffs into several groups according to the sizes thereof, the assembly of the conveyer belt unit 13, the foodstuff collecting unit 14 and the counting unit 15 may be changed according to that shown in FIG. 5. As illustrated, the arrangement 151' of this embodiment is the same as that of the conveyer belt unit 13' and the foodstuff collecting unit 14' is modified. The conveyer belt unit 13' consists of two belt pulleys 131' and five belts 132' which define four slots 133'. The belts 132' are arranged so that the width of the slots 133' increases from the right to the left. The foodstuff collecting unit 14' further includes five large collecting tanks 141'' disposed under the conveyer belt unit 13' between the pulleys 131', which are arranged along the length of the conveyer belt unit 13'. When the lump foodstuffs advance on the conveyer belt unit 13', those of smaller sizes drop from the right portions of the belts 132' and are collected in the right large tanks 141'', while those of larger sizes drop from the left portions of the belts 132 and are collected in the left tanks 141''.

With this invention thus explained, it is apparent that numerous modifications and variations can be made without departing from the scope and spirit of this invention. It is therefore intended that this invention be limited only as indicated in the appended claims.

I claim:

1. An apparatus for counting lump foodstuffs comprising:

a machine frame including a foodstuff feeding funnel fixed thereon;

a sheave unit, mounted rotatably on said machine frame under said funnel so as to receive said foodstuffs which drop from said funnel, having a plurality of parallel annular grooves formed in said as to drop all of said foodstuffs from a side of said sheave unit;

a conveyer belt unit, having a charge end disposed under said sheave unit which receives said foodstuffs dropping from said sheave unit, including two separate belt pulleys mounted rotatably on said machine frame, and a plurality of spaced-apart endless belts engaged with said pulleys so as to form a slot between each adjacent pair of said belts, each of said slots having a first end and a second end, said first ends of said slots corresponding to said charge end of said conveyer belt unit so as to receive said foodstuffs dropping from said sheave unit within said slots in said charge end of said conveyer belt unit, said pulleys effecting a unidirectional rotation so as to move said foodstuffs on said conveyer belt unit from said first ends of said slots to said second ends of said slots;

a foodstuff collecting unit disposed under said conveyer belt unit so as to collect said foodstuffs which drop from said conveyer belt unit; and a plurality of counters on said frame respectively counting said foodstuffs which drop from one of said slots in said conveyer belt unit into said collecting unit;

whereby, said foodstuff dropping from said sheave unit can be dispersed on said conveyer belt unit so as to enable all of said foodstuffs to be counted by said counters.

2. An apparatus as claimed in claim 1, wherein a width of said slots in said conveyer belt unit increases from said first ends of said slots to said second ends of said slots, said foodstuff collecting unit including a series of collecting tanks positioned under said slots along length of said conveyer belt unit, whereby, said foodstuffs of smaller sizes are collected in said collecting tanks nearer to said first ends of said slots, while said foodstuffs of larger sizes are collected in said collecting tanks nearer to said second ends of said slots.

3. An apparatus as claimed in claim 1, wherein said sheave unit includes a rotating shaft mounted rotatably on said machine frame, and a plurality of endless belts sleeved rigidly on said rotating shaft.

4. An apparatus for counting lump foodstuffs comprising: a machine frame including a foodstuff feeding funnel fixed thereon;

a sheave unit, mounted rotatably on said machine frame under said funnel so as to receive said foodstuffs which drop from said funnel, having a plurality of parallel annular grooves formed in said sheave unit, rotatable in a predetermined direction so as to drop all of said foodstuffs from a side of said sheave unit:

a conveyor belt unit, having a charge end disposed under said sheave unit which receives said foodstuffs dropping from said sheave unit, including two separate belt pulleys mounted rotatably on said machine frame, and a plurality of spaced-apart endless belts engaged with said pulleys so as to form a slot between each adjacent pair of said belts, each of said slots having a first end and a second end, said first ends of said slots corresponding to said charge end of said conveyor belt unit so as to receive said foodstuffs dropping from said sheave unit within said slots in said charge end of said conveyor belt unit, said pulleys effecting a unidirection rotation so as to move said foodstuffs on said conveyer belt unit from said first ends of said slots to said second ends of said slots;

a foodstuff collecting unit disposed under said conveyer belt so as to collect said foodstuffs which drop from said conveyer belt unit; and a plurality of counters located adjacent to and aligned with said slots for respectively counting said foodstuffs as said foodstuffs drop from one of said slots in said conveyer belt into said collecting unit;

whereby the said foodstuffs dropping from said sheave unit can be dispersed on said conveyer belt unit so as to enable all of said foodstuffs to be counted by said counters.

* * * * *

UNITED STATES PATENT AND TRADEMARK OFFICE

CERTIFICATE OF CORRECTION

PATENT NO. : 4,963,720

DATED : October 16, 1990

INVENTOR(S) : Jiunn-Neng Jong

It is certified that error appears in the above-identified patent and that said Letters Patent is hereby corrected as shown below:

Column 1, line 53, after the word "conveyer" insert --belt unit increases from the first ends thereof to the--.

Column 3, line 5, after the word "arrangement" insert --of the large collecting tanks 141' and the counters--.

Column 3, line 6, after the second "the" insert --previous embodiment, but the arrangement of the--.

Signed and Sealed this

Second Day of March, 1993

*Attest:*

STEPHEN G. KUNIN

*Attesting Officer*

*Acting Commissioner of Patents and Trademarks*